US006152761A

United States Patent [19]

Wellinsky et al.

[11] Patent Number: 6,152,761

[45] Date of Patent: Nov. 28, 2000

[54] OVERMOLDED CONNECTOR AND METHOD FOR MANUFACTURING SAME

[75] Inventors: Wayne T. Wellinsky, Moore, S.C.; Eric D. Juntwait, Irvine, Calif.

[73] Assignee: Thomas & Betts International, Inc., Sparks, Nev.

[21] Appl. No.: 08/874,395

[22] Filed: Jun. 13, 1997

[51] Int. Cl.[7] ..... H01R 13/58

[52] U.S. Cl. ..... 439/456; 439/736

[58] Field of Search ..... 439/736, 748, 439/456–458; 123/90.11

[56] References Cited

U.S. PATENT DOCUMENTS

| | | | |
|---|---|---|---|
| 4,161,817 | 7/1979 | Bernardo et al. | 29/630 |
| 4,314,960 | 2/1982 | Hass | 264/276 |
| 4,339,407 | 7/1982 | Leighton | 264/229 |
| 4,470,786 | 9/1984 | Sano et al. | 425/125 |
| 4,495,130 | 1/1985 | Hedrick | 264/255 |
| 4,524,948 | 6/1985 | Hall | 251/139 |
| 4,954,940 | 9/1990 | Chandler et al. | 439/687 |
| 5,108,955 | 4/1992 | Ishida et al. | 437/214 |
| 5,201,883 | 4/1993 | Atoh et al. | 29/883 |
| 5,274,917 | 1/1994 | Corbett, III et al. | 29/860 |
| 5,374,176 | 12/1994 | Jang | 425/176 |
| 5,456,791 | 10/1995 | Ueno | 156/556 |
| 5,833,489 | 11/1998 | Kim | 439/456 |

FOREIGN PATENT DOCUMENTS

| | | | |
|---|---|---|---|
| 0 644 615 A2 | 3/1995 | European Pat. Off. . | |
| 2256105 | 6/1974 | Germany | 439/456 |

*Primary Examiner*—Paula Bradley
*Assistant Examiner*—Briggitte R. Hammond
*Attorney, Agent, or Firm*—Hoffmann & Baron, LLP

[57] ABSTRACT

An electrical connector which includes electrical connector contacts and flexible wires extending from the contacts is formed. The connector is formed having an internal skeletal mold insert which includes means for supporting and aligning the electrical contacts and means for anchoring the wires to the skeletal mold insert. The wires are electrically connected to the contacts and mechanically affixed to the wire anchor means such that wire stability and alignment is insured during an overmolding process. The skeletal mold insert, contacts and wire form a subassembly which is overmolded with a substantially insulative material to form the finished connector.

5 Claims, 3 Drawing Sheets

OVERMOLDED CONNECTOR AND METHOD FOR MANUFACTURING SAME

BACKGROUND OF THE INVENTION

1. Field of the Invention

The present invention relates generally to electrical connectors and more particularly relates to an overmolded connector with wires affixed to the connector contacts and a method of fabricating the same.

2. Description of the Prior Art

Electrical connectors which have conductive contacts encapsulated by a molded insulative material are well known in the prior art. Such connectors generally provide a reliable, hermetically sealed connection suitable for use in hostile environments, such as automotive applications. However, when a connector is to be formed which includes flexible wires affixed to the contacts, many manufacturing problems are known to arise. Flexible conductive wires are used within a connector assembly to provide internal inter-contact connection, to provide internal connections to integral electronic components and to provide connections to a point outside of the connector. To simplify the description herein, these flexible wires will generally be referred to as "flying leads" regardless of their specific function in the connector.

Traditionally, to form a connector with flying leads, wires are first attached to the contacts. The contacts and wires are then inserted into a tooled mold which supports the contacts in a suitable position. Finally, an insulative material is injected into the mold to encapsulate the contacts and wires in position. This process is commonly referred to as overmolding. However, if the wires move during the overmolding process, the wall thickness of the molded part will be inconsistent. This can result in component weakness and visual component defects.

U.S. Pat. No. 5,374,176 to Jang discloses a wire clamping device for use with an injection molding machine. The '176 patent discloses the use of the clamping device to maintain the position of conductors which extend from an electronic circuit to be encapsulated by the injection molding device. To use this clamping device, the circuit to be encapsulated is placed in a suitable mold form with the conductors extending therefrom. The conductors are aligned within the clamping device which is then engaged to maintain the conductor position. The clamp maintains the conductor position throughout the molding process. While conductor alignment is achieved, the use of this clamp has a disadvantage in that each part to be encased must be carefully aligned in the clamp structure prior to molding. This requires a degree of care and skill in the mold machine operator to insure consistent results in the finished product.

U.S. Pat. No. 4,339,407 to Leighton also discloses a method for electronic circuit encapsulation. The '407 patent teaches the preassembly of an electronic circuit to be encapsulated and the placement of this preassembled circuit into a preformed mold carrier. The mold carrier is formed with an internal configuration of lands and grooves which facilitates circuit insertion and position maintenance. The mold carrier further includes prelocated perforations to allow circuit conductors to extend beyond the carrier for interconnection to the encapsulated circuit. This method of encapsulation requires preassembly of the components in a free form fashion with sufficient precision to allow a proper fit of the circuit within the carrier. The degree of precision which is required is a disadvantage in high volume manufacturing processes.

OBJECTS AND SUMMARY OF THE INVENTION

It is an object of the present invention to provide a connector structure with internal flying leads attached to the connector contacts, the connector featuring accurate alignment of the contacts within a connector housing.

It is another object of the present invention to provide a connector with flying leads which provides positive, repeatable wire routing within the connector body.

It is yet another object of the present invention to provide a connector with flying leads which has uniform and repeatable wall thickness in an overmolded connector housing.

It is still a further object of the present invention to provide a structure for supporting contacts and maintaining wire alignment during an overmolding process for a connector with flying leads.

It is yet a further object of the present invention to provide a method of manufacturing a connector structure with flying leads which overcomes problems previously encountered in the prior art.

In accordance with one form of the present invention a connector having contacts and flexible conductors is formed with an internal skeletal mold insert. The skeletal mold insert includes means for supporting and aligning the connector contacts in a substantially rigid manner. The skeletal mold insert further includes wire anchoring means. The wire anchoring means are held in fixed alignment with the contact support means. The conductors are held in a substantially fixed position by the wire anchor means and are electrically connected to a corresponding connector contact. The skeletal mold insert with affixed contacts and conductors is overmolded with an insulative outer layer which hermetically encapsulates the skeletal mold assembly and forms the finished connector body.

In accordance with a method of the present invention, a connector having electrical contacts and flying leads is formed around a skeletal mold insert which includes contact support means and wire anchor means. The method includes the steps of: affixing electrical contacts to the contact support means; attaching conductors to the contacts; affixing the conductors to the wire anchor means; and overmolding an outer shell about the skeletal mold insert assembly to form a finished connector.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
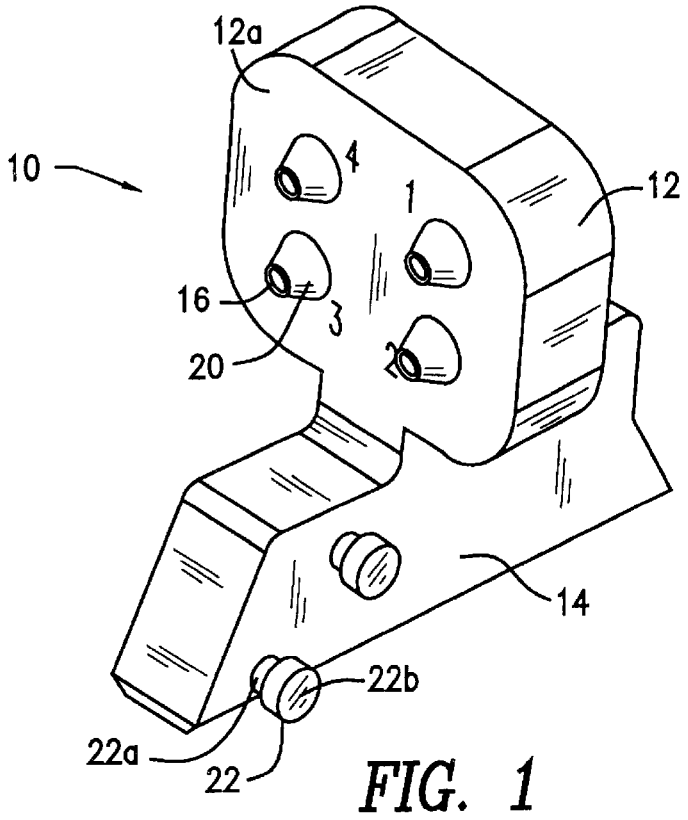
FIG. 1 is a perspective view, front view, of a skeletal mold insert including contact support means and wire anchor means, formed in accordance with the present invention.
Figure 2:
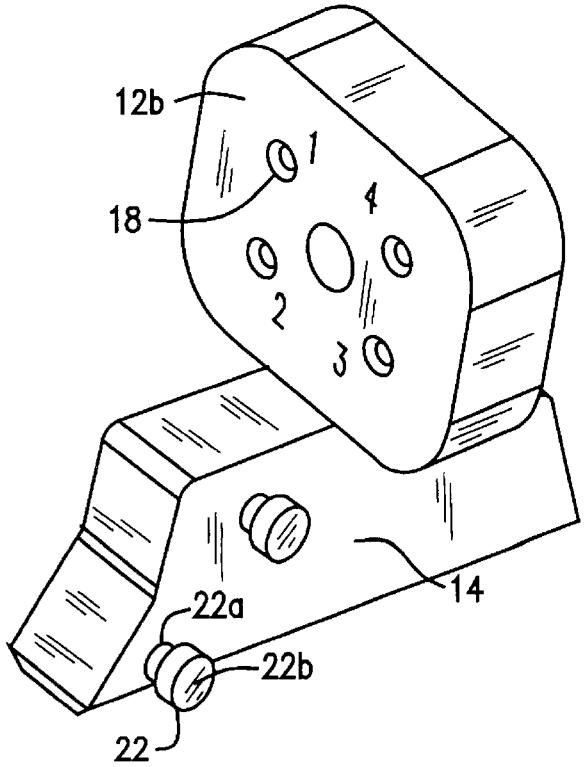
FIG. 2 is a perspective view, rear view, of a skeletal mold insert including contact support means and wire anchor means, formed in accordance with the present invention.
Figure 3:
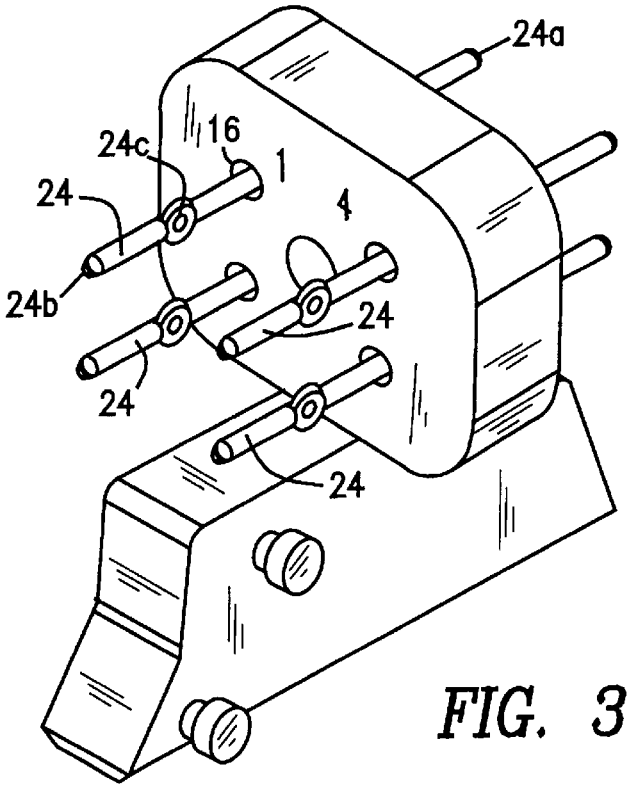
FIG. 3 is a perspective view of the skeletal mold insert of FIGS. 1 and 2, further illustrating electrical contacts inserted within the exemplary contact support means.

An electrical connector with flying leads, formed in accordance with the present invention, is fabricated using a skeletal mold insert to form a mold insert subassembly. FIGS. 1 and 2 are perspective views, front and rear respectively, illustrating an exemplary embodiment of the skeletal mold insert formed in accordance with the present invention. FIG. 3 further illustrates the skeletal mold insert in cooperation with electrical contacts 24. Preferably, the skeletal mold insert 10 is formed as a unitary structure having a connector support section 12 and a wire anchor section 14. The skeletal mold insert 10 is preferably formed from a substantially rigid, non conductive material.

The contact support section 12 is provided for supporting electrical contacts 24. The electrical contacts 24 will be placed within the skeletal mold insert 10 prior to overmolding. In one embodiment of the present invention, the connector support section 12 is a substantially planar member with a front surface 12*a*, a spaced back surface 12*b* parallel to and opposing the front surface 12*a* and a thickness separating the front surface 12*a* and back surface 12*b*. Each contact 24 is supported in contact support section 12 by a channel or passage 16 extending through the planar member between the front surface 12*a* and the back surface 12*b*.

Each contact supporting passage 16 is sized and shape to receive and hold a selected electrical contact 24. Preferably, the contact supporting passage 16 include a slightly enlarged, beveled opening 18 on one of the front face 12*a* or rear face 12*b* to facilitate the insertion of the contact 24. Further, the face opposing the face having the beveled opening 18 will preferably include an extending collar 20. The collar 20 is formed as a substantially perpendicularly extending member from one face of the planar member 12. The collar 20 forms a tapered, restrictive extension coaxially aligned with the perforation 16 which provides an enhanced friction fit to hold a contact 24 inserted within the passage 16. This configuration allows for easy insertion of contacts 24 through the contact support section 12 while still providing sufficient stability to the contact 24 during an overmolding process. The extending collar 20 allows the thickness of the planar member 12 to be reduced without impairing contact support.

The skeletal mold insert 10 further includes a wire anchor section 14 and a plurality of wire anchoring element 22. FIGS. 1–4 illustrate an exemplary embodiment of the skeletal mold insert 10 wherein the wire anchor section 14 is formed as a substantially planar member affixed in perpendicular alignment to the contact support section 12. However, it will be appreciated that the specific geometry of the wire anchor section 14 and its alignment with the contact support section 12 is not critical to the practice of the present invention.

Preferably, each wire anchoring element 22 takes the form of a shaft 22*a* which perpendicularly extends from a face of the anchor section 14. To retain a wire on the shaft 22*a*, the shaft 22*a* is preferably terminated in an enlarged knob 22*b*. The wire to be anchored is wound with at least one turn about the shaft 22*a* and held in place by knob 22*b*. The length and diameter of the shaft 22*a* and the diameter of the knob 22*b* are selected such that a wire may be wrapped around the shaft 22*a* and retained in position against the wire anchor section 14 by the enlarged knob 22*b*. These sizes are largely a function of the wire diameter.

Alternative forms of the wire anchoring element 22 are contemplated as being within the scope of the present invention. Such alternatives include split shafts, perforated retainers, extending hooks and other extensions which can effectively retain a wire in a like fashion.

FIG. 3 further illustrates the skeletal mold insert of FIGS. 1 and 2 with electrical contacts 24 inserted within the contact support passages 16. The contacts 24 illustrated have a first end 24*a* for interfacing with a suitable mating contact and a second end 24*b* for electrical interface with a conductive wire. The contacts 24 illustrated in FIG. 3 further include an aperture 24*c* located proximate the second end 24*b* for receiving a wire therethrough. The aperture 24*c* maintains the wire position prior to and during a soldering operation. Alternatively, the wire may be wound around the contact 24 or may include an end cap 26 which fits over the contact 24 (FIG. 4).

Figure 4:
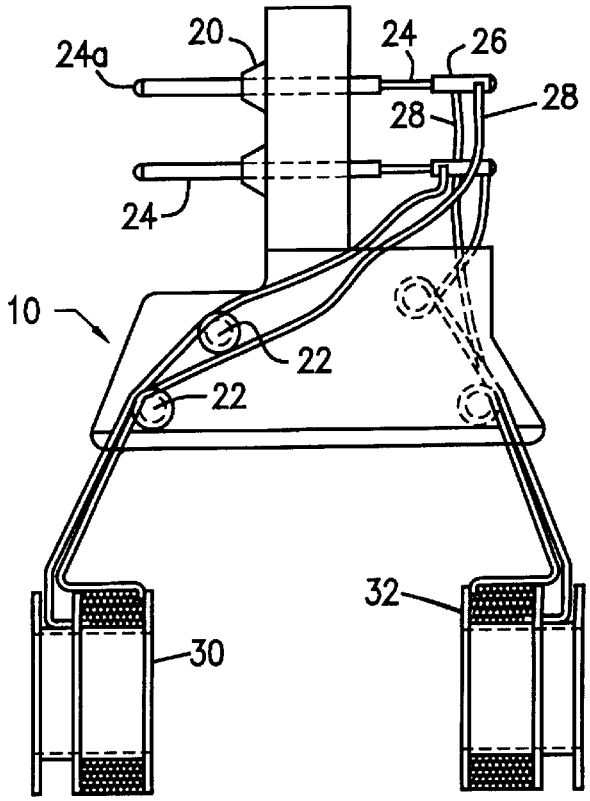
FIG. 4 is a side view of the skeletal mold insert of FIGS. 1–3, further illustrating the electrical contacts being supported by the contact support means and flying leads being retained by exemplary wire anchors.

Referring to FIG. 4, the skeletal mold insert 10 is shown in cooperation with electrical contacts 24 and wires 28. The wires 28 are connected to the electrical contacts 24 and affixed to the wire anchor elements 22.

The exemplary embodiment illustrated in FIG. 4 is for an electromagnetic, automotive valve actuator. The automotive valve actuator includes four electrical contacts 24 configured as two contact pairs. Each contact pair is associated with a wire having two ends which is wrapped about a form to establish an electromagnetic coil 30,32. In the embodiment of FIG. 4, two such electromagnetic coils 30,32 are affixed to the skeletal mold insert 10.

Figure 7:
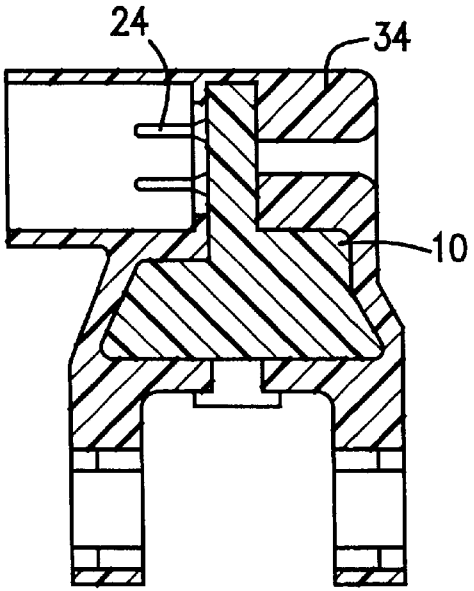
FIG. 7 is a section view of an overmolded connector formed in accordance with the present invention, further illustrating the skeletal mold insert in cooperation with the overmolded insulative shell.
Figure 6:
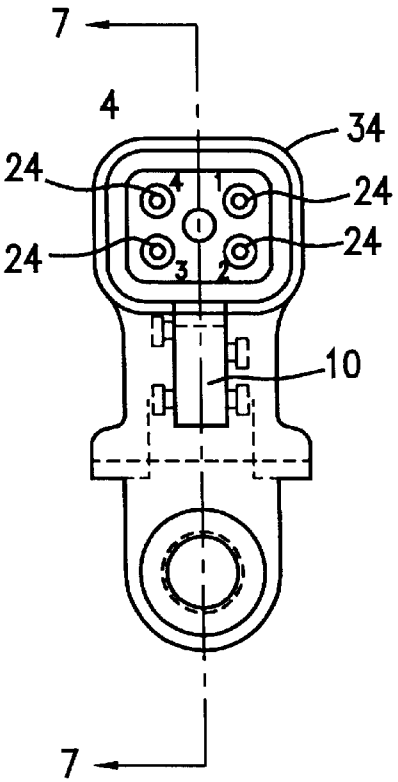
FIG. 6 is a front view of an overmolded connector formed in accordance with the present invention.
Figure 5:
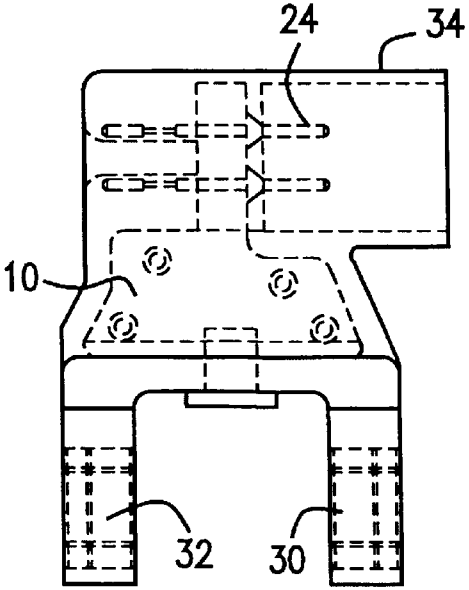
FIG. 5 is a cross-sectional view of an overmolded connector formed in accordance with the present invention.

FIGS. 5 through 7 further illustrate an overmolded connector formed in accordance with the present invention. FIGS. 5–7 are also directed to the automotive valve actuator illustrated in FIG. 4. To form this actuator, the skeletal mold insert 10, connectors 24 and wire coil assemblies 30,32 are placed within a suitable mold form. An electrically insulate material is then injected within the mold form thereby overmolding the skeletal mold insert subassembly forming the outer connector body 34. The size, shape and contour of the outer connector body 34 may take any suitable form to accomplish a specific connector function.

In the case of the automotive valve actuator, the first coil 30 and second coil 32 are positioned to oppose one another with a gap therebetween. The automotive valve will then be positioned within the gap between the coils 30,32. When a voltage is applied across the contact pairs, a magnetic field is generated in coils 30,32 which operates the valve.

An overmolded connector formed in accordance with the present invention features lower manufactured cost and greater consistency between parts. By anchoring the flying leads to a skeletal mold insert, controlled wire position is obtained without the use of sophisticated molding clamps. Further, as the skeletal mold insert is preassembled outside of the mold, the molding process is significantly simplified.

Although illustrative embodiments of the present invention have been described herein with reference to the accompanying drawings, it is to be understood that the invention is not limited to those precise embodiments, and that various other changes and modifications by effected therein by one skilled in the art without departing from the scope or spirit of the invention.

What is claimed is:

1. An electrical connector which includes electrical connector contacts and flexible conductive flying leads, the connector further comprising:

a skeletal mold insert formed as a unitary structure, the skeletal mold insert comprising:

contact support means defined by a contact support section for receiving and rigidly aligning the electrical connector contacts, said contact support section comprising a substantially planar member having a first surface, a second surface opposing the first surface and a thickness between the first surface and second surface and wherein the contact support means comprises at least one perforation per electrical contact, the at least one perforation extending through the planar member between the first and second surface; and wire anchor section defined by wire anchor means, the wire anchor means maintained in rigid alignment with the contact support means, the flying leads mechanically interfacing with the wire anchor means such that the flying leads are substantially affixed to the wire anchor means, and wherein the wire anchor section comprises a substantially planar member and wherein the wire anchor means includes at least one shaft, the at least one shaft affixed to and substantially perpendicularly extending from the wire anchor section, the flexible conductive flying leads being wound around the at least one shaft whereby the flying leads are substantially affixed to the skeletal mold insert; and an overmolded substantially insulated outer connector body, the outer connector body encapsulating the electrical contacts, flying leads, contact support means, and wire anchor means.

2. An electrical connector as defined by claim 1, wherein each at least one shaft is terminated in a knob, the knob having a diameter larger than a diameter of the shaft, whereby a flexible conductive flying lead wrapped around the shaft is retained on the shaft.

3. An electromagnetic automatic valve actuator comprising:

at least two electrical contacts;

at least one electromagnetic coil, each at least one electromagnetic coil being formed from a flexible wire having two extending flying leads;

a skeletal mold insert formed as a unitary structure, the skeletal mold insert comprising:

contact support means defined by a contact support section for receiving and rigidly aligning the electrical connector contacts, wherein the contact support section comprises a substantially planar member having a first surface, a second surface opposing the first surface and a thickness between the first surface and second surface and wherein the contact support means comprise at least one perforation per electrical contact, the at least one perforation extending through the planar member between the first and second surface; and wire anchor means, the wire anchor means maintained in rigid alignment with the contact support means, the flying leads mechanically interfacing with the wire anchor means such that the flying leads are substantially affixed to the wire anchor means; and an overmolded substantially insulated outer connector body, the connector body encapsulating the electrical contacts, flying leads, contact support means, and wire anchor means.

4. An electromagnetic automotive valve actuator as defined by claim 3, wherein the wire anchor section comprises a substantially planar member and wherein the wire anchor means include at least one shaft, the at least one shaft affixed to and substantially perpendicularly extending from the wire anchor section, the flexible conductive flying leads being wound around the at least one shaft whereby the flying leads are substantially fixed to the skeletal mold insert.

5. An electromagnetic automotive valve actuator as defined by claim 4, wherein each at least one shaft is terminated in a knob, the knob having a diameter larger than a diameter of the shaft, whereby a flexible conductive flying lead wrapped around the shaft is retained on the shaft.

* * * * *